US009003750B2

(12) United States Patent
Bruzzesi et al.

(10) Patent No.: US 9,003,750 B2
(45) Date of Patent: Apr. 14, 2015

(54) DEBRIS SWEEP AND DRY ASSIST DEVICE FOR STRAP PRINTING

(75) Inventors: Kevin A. Bruzzesi, Cary, IL (US); Wayne J. Thas, Arlington Heights, IL (US)

(73) Assignee: Signode Industrial Group, LLC, Glenview, IL (US)

( * ) Notice: Subject to any disclaimer, the term of this patent is extended or adjusted under 35 U.S.C. 154(b) by 604 days.

(21) Appl. No.: 13/310,207

(22) Filed: Dec. 2, 2011

(65) Prior Publication Data

US 2012/0174530 A1 Jul. 12, 2012

Related U.S. Application Data

(60) Provisional application No. 61/431,991, filed on Jan. 12, 2011.

(51) Int. Cl.

| | |
|---|---|
| ***B65B 13/04*** | (2006.01) |
| ***B65B 27/00*** | (2006.01) |
| ***B65B 13/18*** | (2006.01) |
| ***B65B 55/24*** | (2006.01) |
| ***B65B 61/02*** | (2006.01) |

(Continued)

(52) U.S. Cl.

CPC ..... *B65B 27/00* (2013.01); *B65B 13/18* (2013.01); *B65B 55/24* (2013.01); *B65B 61/025* (2013.01); *B65B 13/06* (2013.01); *B41J 1/00* (2013.01)

(58) Field of Classification Search

CPC ..... B65B 13/06; B08B 5/00; B08B 5/02; B08B 5/023; B08B 5/026; B08B 5/043; B08B 5/046; B08B 3/02; B08B 3/022; B08B 1/02; B41J 29/17; B41J 11/0015; B41J 2/16538

USPC ..... 53/589, 582, 131.2, 131.4, 141; 15/3.13, 3.16, 300.1, 306.1, 316.1, 15/308, 309.1; 100/8, 25, 26; 101/37, 40, 101/40.1, 43, 44; 347/4, 101, 102; 242/615.11, 615.12, 899; 226/7, 97.1, 226/97.3, 102, 200

See application file for complete search history.

(56) References Cited

U.S. PATENT DOCUMENTS

| | | | | |
|---|---|---|---|---|
| 3,436,265 | A * | 4/1969 | Gardner | 134/37 |
| 3,515,055 | A * | 6/1970 | Timmerbeil et al. | 100/3 |

(Continued)

FOREIGN PATENT DOCUMENTS

| | | | |
|---|---|---|---|
| GB | 2247874 | A | 3/1992 |
| JP | 2003047922 | A | 2/2003 |

OTHER PUBLICATIONS

International Search Report and the Written Opinion of the International Searching Authority (EPO) issued in connection with PCT/US2012/020881 on Apr. 27, 2012.

*Primary Examiner* — Stephen F Gerrity
*Assistant Examiner* — Joy N Sanders
(74) *Attorney, Agent, or Firm* — Levenfeld Pearlstein, LLC

(57) ABSTRACT

A debris sweep and dry assist device is for use with a strapping machine. The debris sweep and dry assist device is positioned between the strapping machine and an associated strap supply. The device includes a body having a strap inlet and a strap outlet and defining a strap path therethrough. The body has a first wall at about the strap inlet and a second wall at about the strap outlet. The body has a first manifold and a plurality of first branches extending between the first manifold and the first wall to provide a plurality of flow paths from the first manifold to the environs through the first branches. A compressed is gas directed into the first manifold and flows out of the first branches, and is directed onto strap material at a location at about the strap inlet.

20 Claims, 6 Drawing Sheets

(51) Int. Cl.
*B65B 13/06* (2006.01)
*B41J 1/00* (2006.01)

(56) References Cited

U.S. PATENT DOCUMENTS 3,783,575 A * 1/1974 Angenendt ..... 53/399
4,364,147 A * 12/1982 Biedermann et al. ..... 15/404
4,594,748 A 6/1986 Warfvinge
5,836,044 A * 11/1998 Sinnett et al. ..... 15/309.1
6,598,261 B2 * 7/2003 Howard ..... 15/308
7,197,858 B2 * 4/2007 Viaud ..... 53/137.2
7,854,195 B2 * 12/2010 Van Groenigen ..... 100/8
2007/0163454 A1 * 7/2007 Orlandi et al. ..... 101/45

* cited by examiner

DEBRIS SWEEP AND DRY ASSIST DEVICE FOR STRAP PRINTING

CROSS-REFERENCE TO RELATED APPLICATION DATA

This application claims the benefit of priority of U.S. Provisional Application Ser. No. 61/431,991, filed Jan. 12, 2011.

BACKGROUND

Strap material is used to bundle or package a wide variety of materials. The strap can be formed from metal or polymer and can be applied manually or using an automated or powered strapping machine.

It may be desirable, or required, to mark many of the materials that are bundled using strap material. For example, a bale of hay is often provided with a marking to indicate the grade of the hay in that bale. Present marking systems use a physical marker, such as a band or tag that is attached to the strap material subsequent to baling. These markers can be misplaced or removed and as a result the initial grade determination may be lost.

Strap printing systems are also known. In one application, a printer is provided in-line in a strapping system, typically located between the strap dispenser and the strapping machine. As the strap is conveyed from the dispenser to the strapping machine, print (indicia) is applied directly to the strap. In known systems, a wet print device, for example, an ink-jet printer, applies indicia directly to the strap material.

While this system works well, there are drawbacks. For example, when used in a debris-laden environment, such as in a hay-baling operation, debris can adhere to the strap. When this occurs, the printer can become clogged or the print may not be completely applied to the strap material due to debris present on the strap at the print location. Moreover, due to the speeds at which these systems operate, the ink may not have sufficient time to dry before it is conveyed into the strapping machine. This can cause the marking to be incomplete or to become smudged or illegible, thus rendering the markings less than useful.

Accordingly, there is a need for a strap printing system that can be used in dusty or debris-laden environments. Desirably, such a system clears debris from the strap prior to printing. More desirably still, such a system assists in reducing the drying time needed for the indicia (ink) applied to the strap so the strapping operation or line-speed is not adversely effected.

SUMMARY

Various embodiments of the present disclosure provide a debris sweep and dry assist device configured for use with a strapping machine and a strap supply. The debris sweep and dry assist device is positioned between the strapping machine and the strap supply. The device can be used as part of a strap printing system.

The debris sweep and dry assist device includes a body having a strap inlet and a strap outlet that define a strap path therethrough. The body has a first wall at about the strap inlet and a second wall at about the strap outlet.

A first manifold is formed in the body and a plurality of first branches extend between the first manifold and the first wall to provide a plurality of flow paths from the first manifold to the environs through the first branches. A compressed gas is directed into the first manifold and flows out of the first branches, directed onto strap material at about the strap inlet.

In one embodiment, the device includes a second manifold in the body and a plurality of second branches that extend between the second manifold and the second wall to provide a plurality of flow paths from the second manifold to the environs through the second branches. A compressed gas is directed into the second manifold and flows out of the second branches, directed onto strap material at about the strap outlet.

In an embodiment, the first and/or second branches are in flow communication with diverging openings in the first and second walls, respectively. The diverging openings can be formed as countersunk regions in the first and second walls, respectively. The branches can be formed at an angle of about 45 degrees to the strap path.

In one embodiment, a receiver is mounted to the body, positioned between the inlet and the outlet. The receiver is configured to receive a printing device, such that a compressed gas, such as air, exiting the first branches clears debris from the strap at the inlet and a compressed gas, such as air, exiting the second branches facilitates drying ink printed on the strap material.

In this manner, the debris sweep and dry assist device of the present disclosure facilitates printing on strap material in an in-line strapping operation in dusty or debris-laden environments, and reduces the drying time needed for the printing (ink) applied to the strap.

A strapping system of the type for receiving strapping material from an associated strap supply and tensioning the strapping material around a load includes a strapping machine having a feed head, a sealing head and a strap chute and a debris sweep and dry assist device positioned between the strapping machine and the associated strap supply. The debris sweep and dry assist device clears debris from the strap material prior to entering the device.

In one strapping system, the debris sweep and dry assist device body includes a receiver mounted to the body, positioned between the inlet and the outlet. The receiver is configured to receive a printing device.

In such an arrangement, the body includes a second manifold and a plurality of second branches extending between the second manifold and the second wall to provide a plurality of flow paths from the second manifold to the environs through the second branches. A compressed gas is directed into the second manifold and flows out of the second branches, directed onto strap material at about the strap outlet. Air directed through the second manifold and branches onto the strap material facilitates drying print on the strap.

A debris sweep print head carrier is configured for use with a strapping machine. The carrier is positioned between the strapping machine and an associated strap supply. The carrier includes a body having a strap inlet and a strap outlet and defines a strap path therethrough. The carrier includes a receiver mounted to the body, positioned between the inlet and the outlet, that is configured to receive a printing device.

These and other features and advantages of the present disclosure will be apparent from the following detailed description, in conjunction with the appended claims.

DETAILED DESCRIPTION

Figure 1:
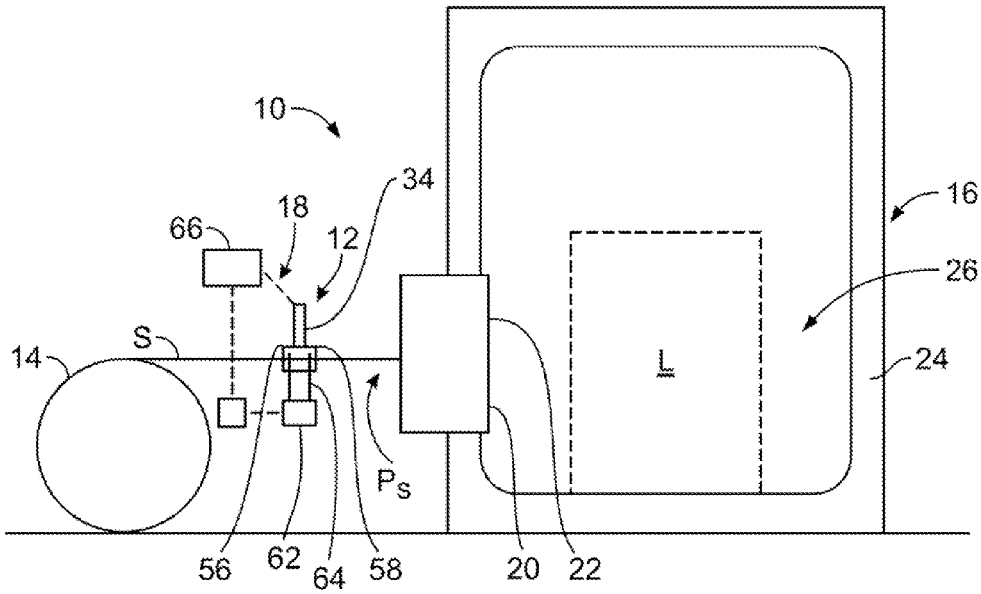
FIG. 1 is a schematic illustration of a strapping operation in which an embodiment of a debris sweep and dry assist apparatus is positioned between a strap supply, such as the illustrated, exemplary dispenser and a strapping machine.

While the present disclosure is susceptible of embodiments in various forms, there is shown in the drawings and will hereinafter be described a presently preferred embodiment with the understanding that the present disclosure is to be considered an exemplification and is not intended to limit the disclosure to the specific embodiment illustrated.

Referring now to the figures and in particular to FIG. 1 there is shown an example of a strapping system 10 in which a debris sweep and dry assist device 12 is positioned between a strap material supply (such as the illustrated dispenser) 14, and a strapping machine 16. The debris sweep and dry assist device 12 is configured with a strap printing system 18 to print indicia I onto the strap S, which device 12 can be used in dusty or debris-laden environments and can operate at speeds equal to that of the strapping machine 16 and bundling operation.

The dispenser 14 provides a quantity of strap material S for feed to the strapping machine 16. A typical strapping machine 16 includes a feed head 20, a sealing head 22 and a strap chute 24. A load L or bundling area 26 is defined within the confines of the strap chute 24. The operation of the strapping system 10 will be understood by those skilled in the art. It will be appreciated that the feed and sealing heads can be combined into a single unit and that the head or heads can be modular in design.

Figure 2:
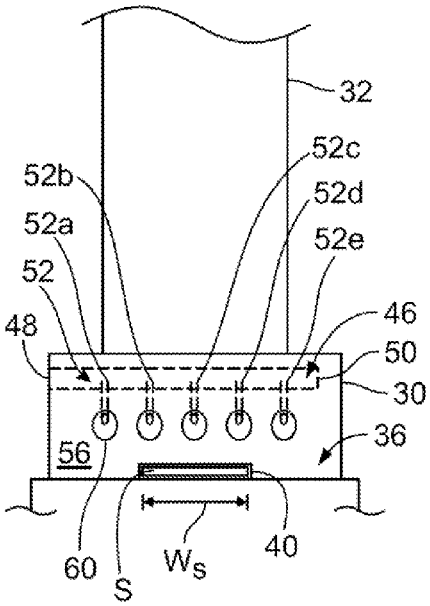
FIG. 2 is a front view of an exemplary debris sweep and dry assist apparatus.
Figure 3:
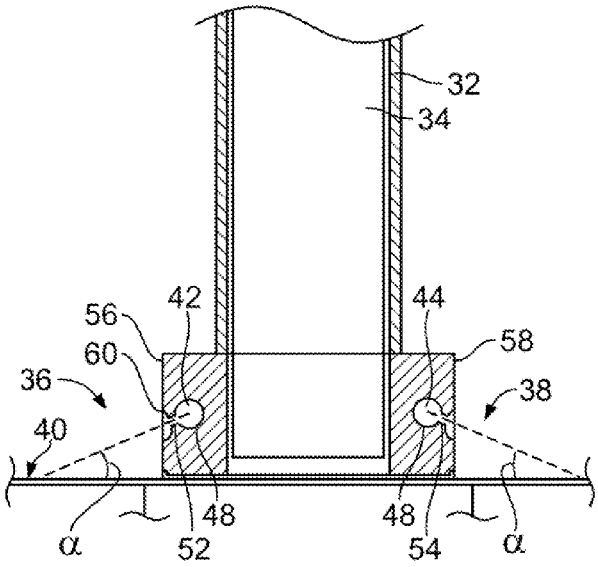
FIG. 3 is a partial sectional view of the debris sweep and dry assist apparatus.
Figure 4:
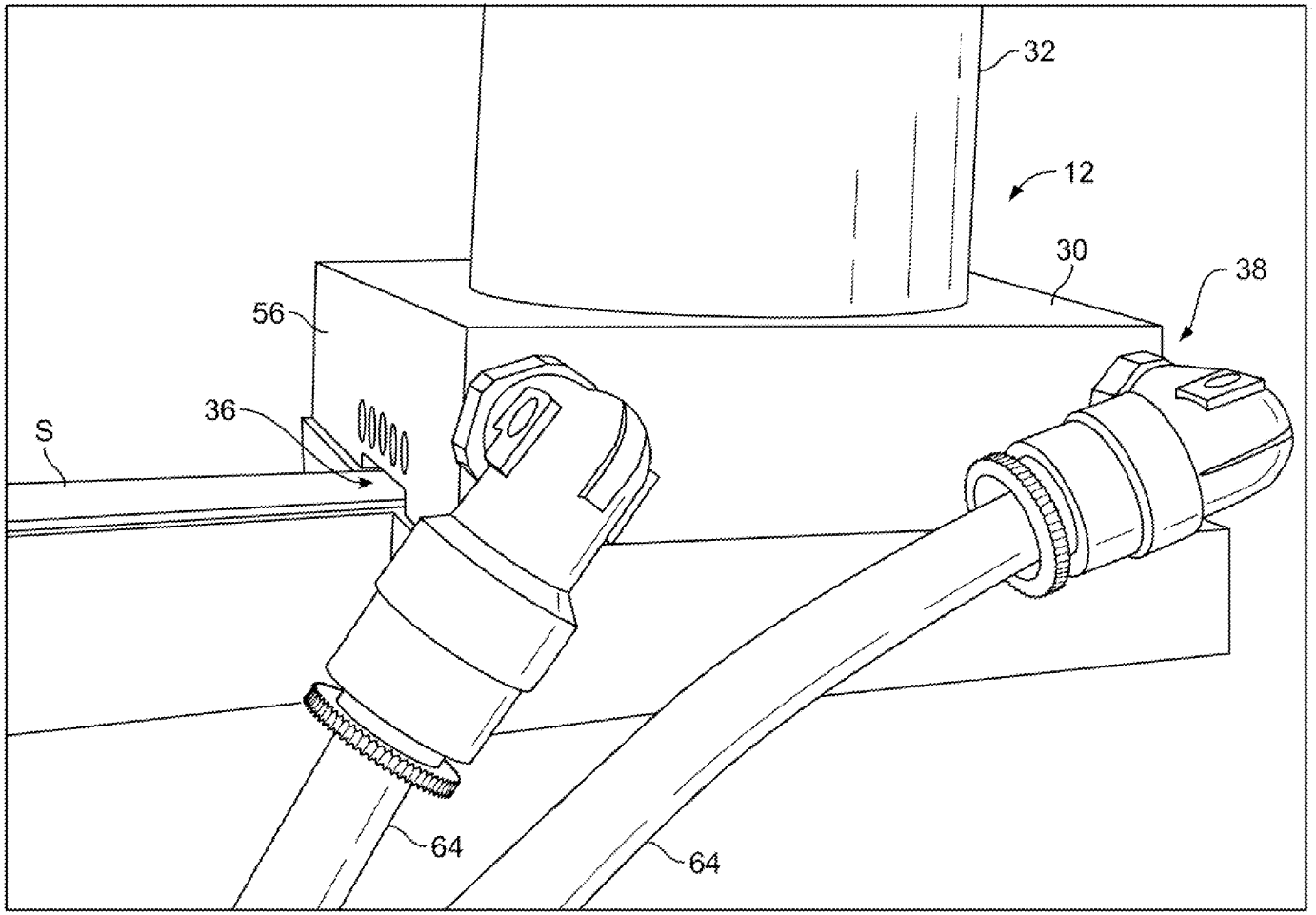
FIG. 4 is a partial view of the base of the debris sweep and dry assist apparatus.
Figure 5:
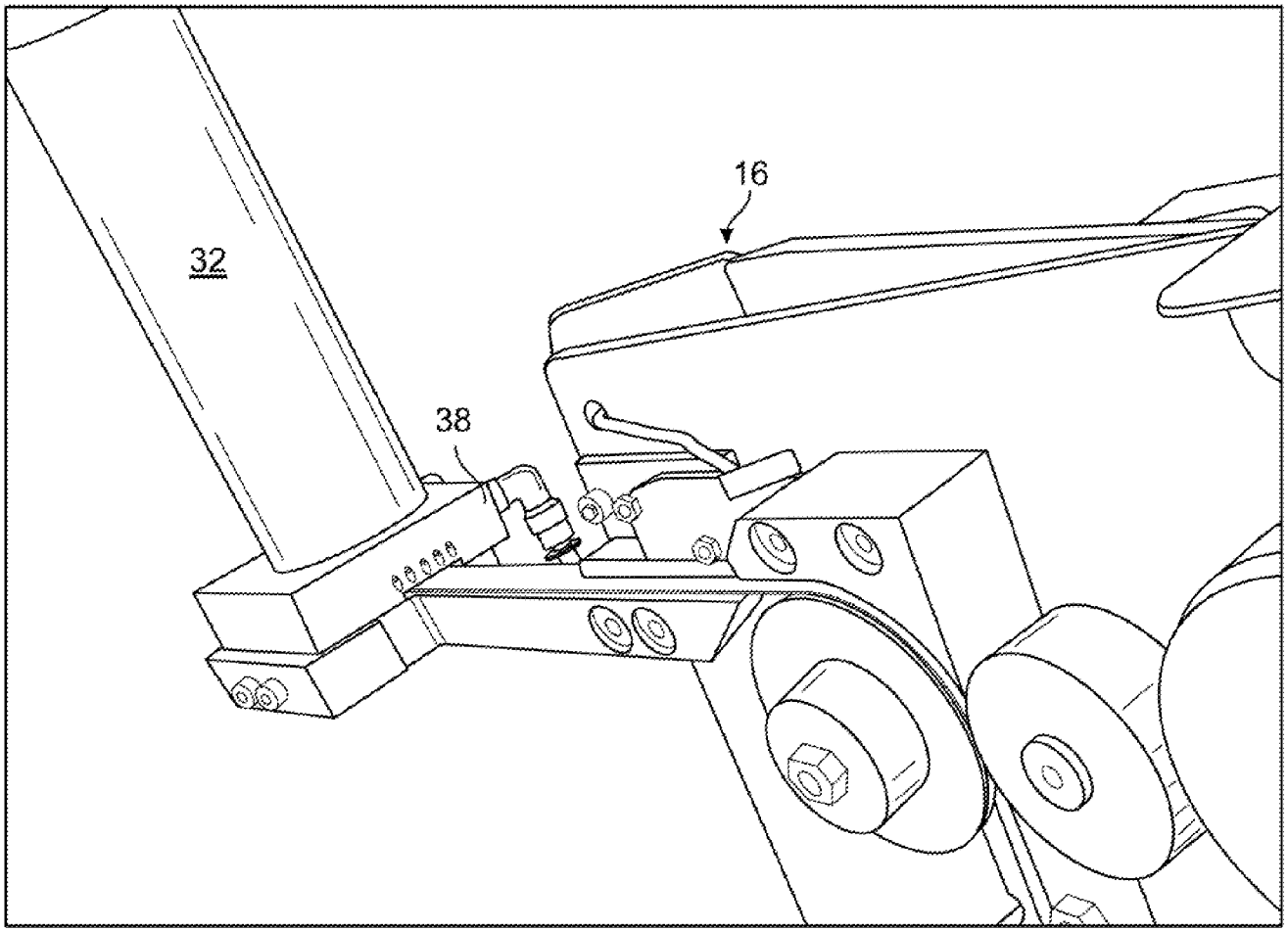
FIG. 5 is a view of the rear of the debris sweep and dry assist apparatus in line in a strapping system.
Figure 6:
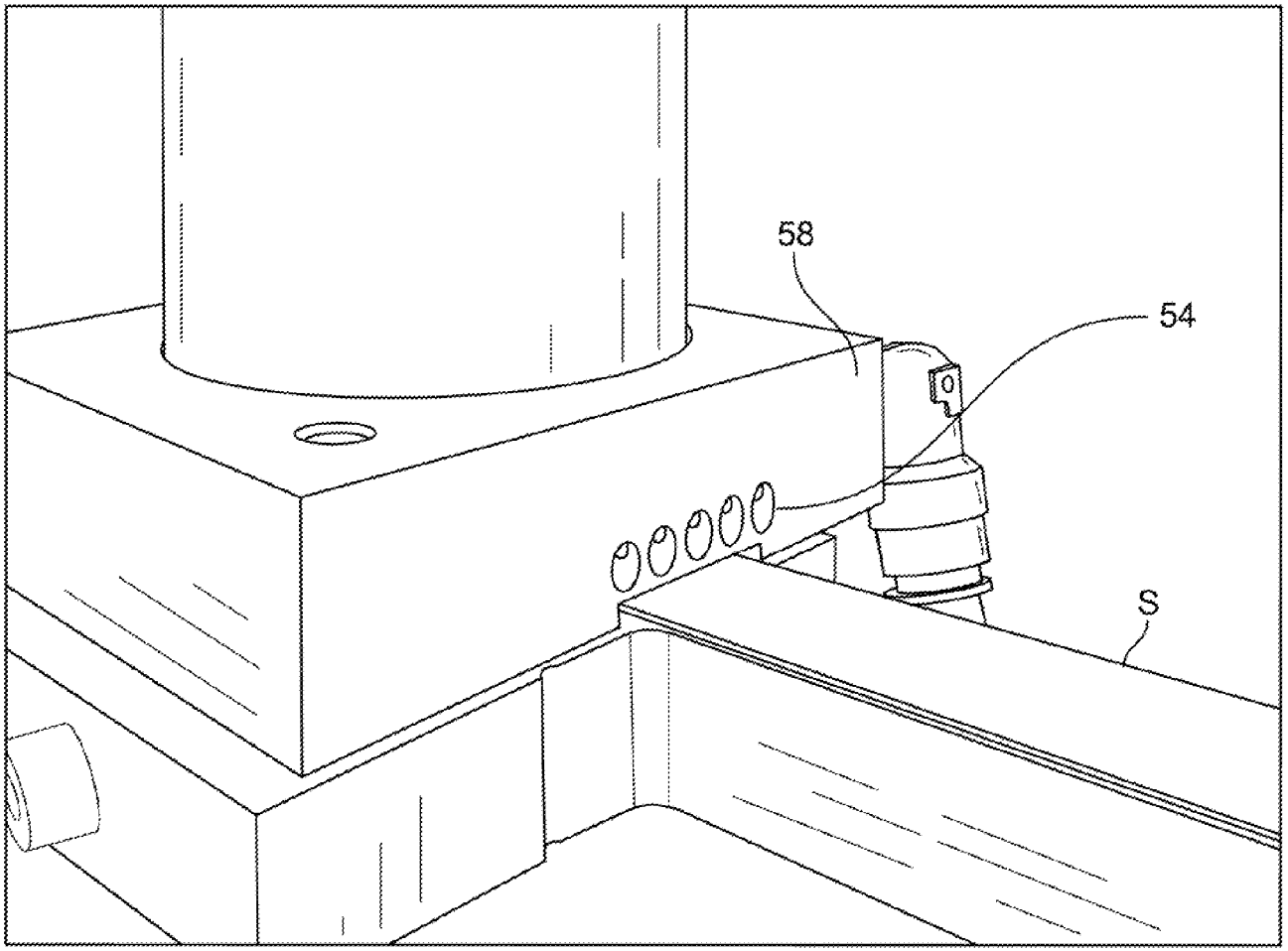
FIG. 6 is another view, enlarged, of the rear of the base of the debris sweep and dry assist apparatus shown with a section of strap material in the apparatus.
Figure 7:
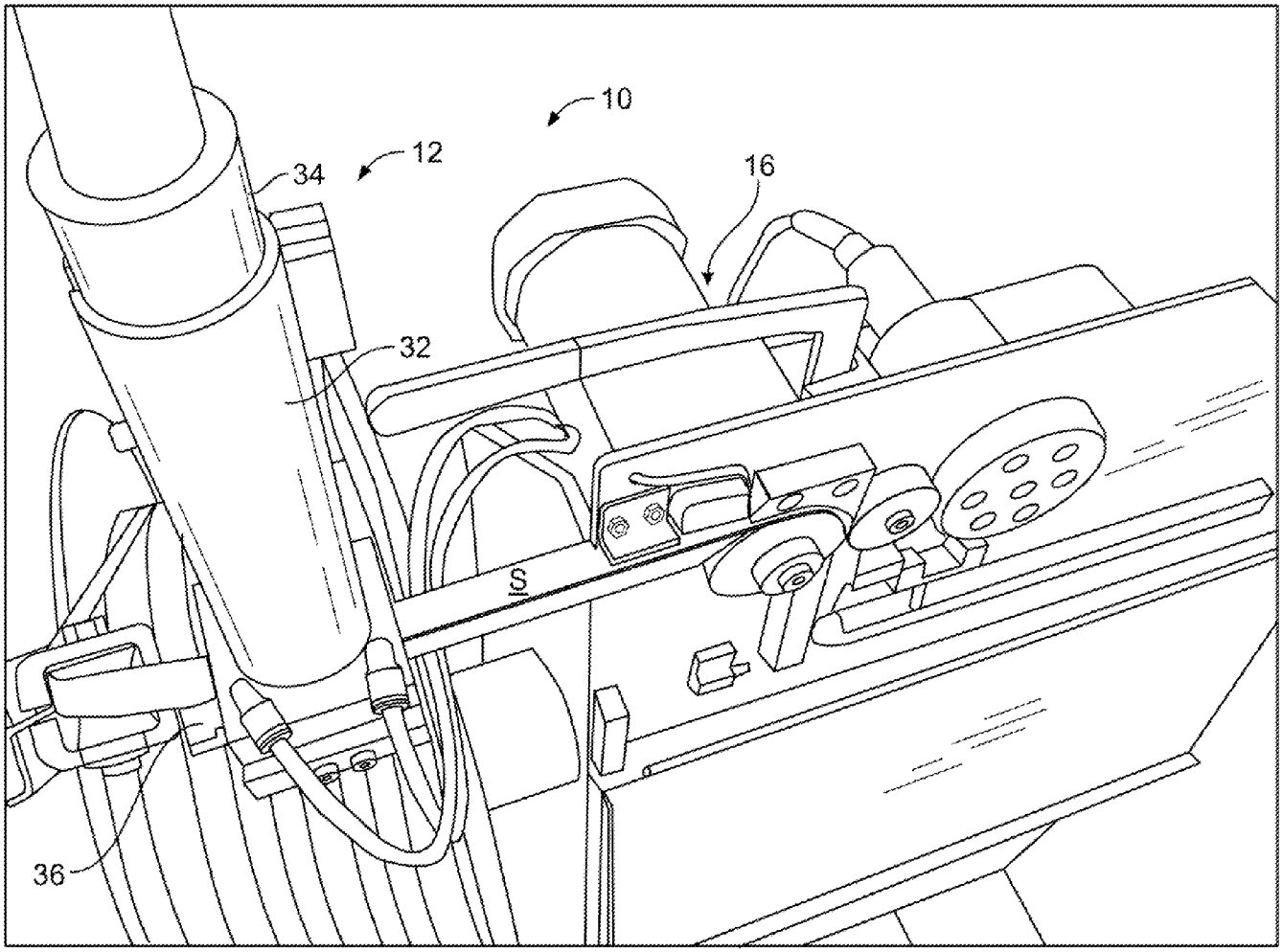
FIG. 7 is view of the debris sweep and dry assist apparatus with a printer installed in a printer carrier or receiver, shown positioned upstream of the strapping machine feed head.
Figure 8:
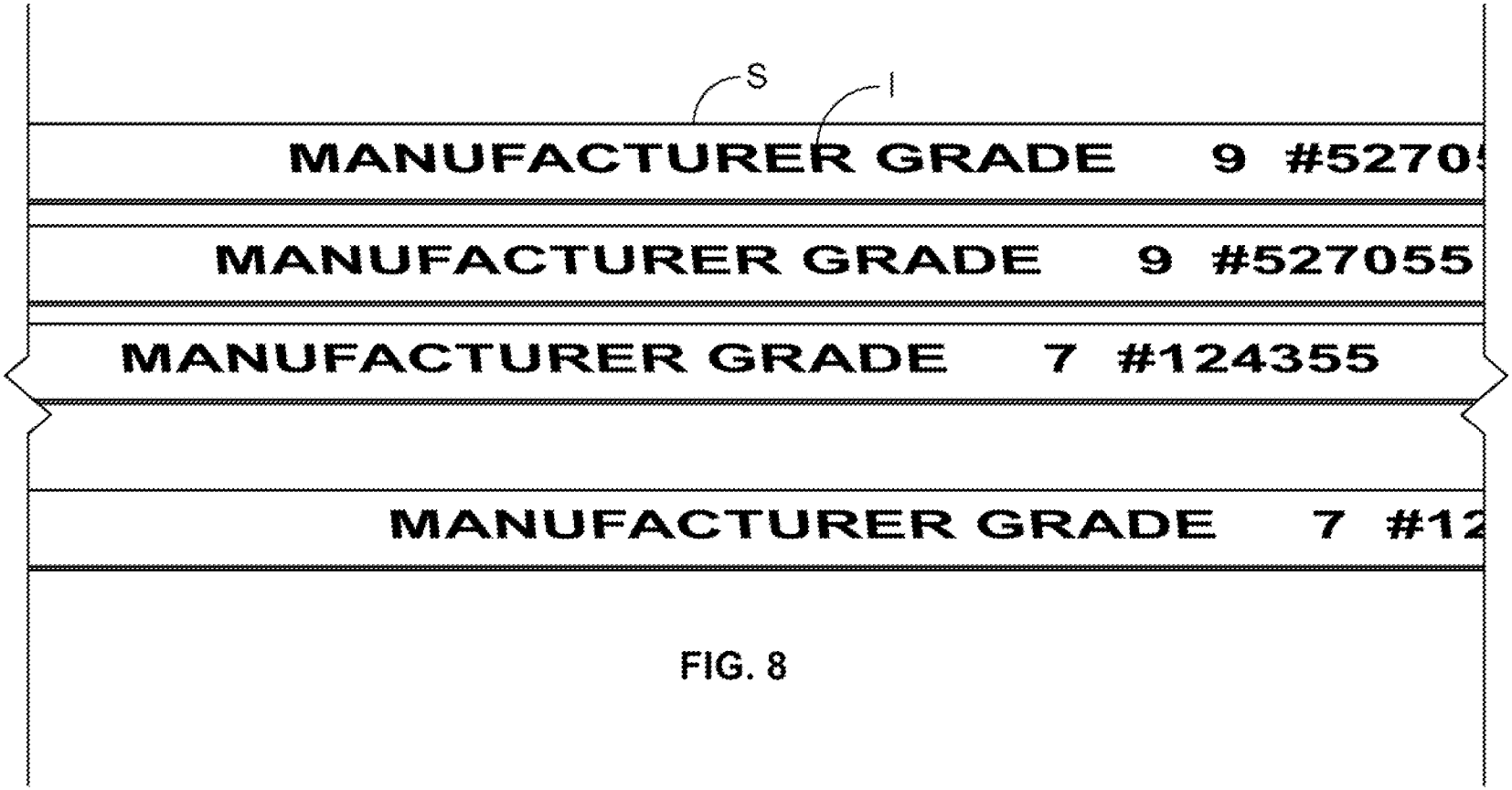
FIG. 8 views of examples of strap material with printing thereon.

Referring now to FIGS. 2 and 3, in the illustrated embodiment, the debris sweep and dry assist device 12 includes a base portion 30 and a carrier or receiver 32 for a printing device 34. The printing device 34 can be, for example, an ink-jet type device that is supported within the carrier 32. Other types of printing devices can, of course be used.

The base portion 30 includes an inlet 36 and an outlet 38 and defines a strap path (as indicated at 40) therethrough. The path 40 positions the strap S for proper application of indicia I (print) from the printer 34. It will, however, be appreciated by those skilled in the art that the printer 34 is just one type of application with which the present debris sweep and dry assist device 12 can be used and that other uses for the device 12 are within the scope and spirit of the present disclosure.

The base portion 30 includes first and second manifolds 42, 44, respectively, formed therein. The manifolds 42, 44 can be, for example, bores 46 in the base portion 30 that extend generally transverse to the strap path 40. The manifolds 42, 44, each include an inlet 48. The bores 46 can be partially formed in the base 30 so as to seal a rear or back end 50 of the manifolds 42, 44. Alternately, the manifold rear ends 50 can be sealed by plugs, fittings, valves or the like (not shown).

A plurality of branches 52, 54 extend from each of the manifolds 42, 44, respectively. The branches 52, 54 are in flow communication with their respective manifolds 42, 44 and are directed toward the strap path 40, generally, at the inlet 36 and outlet 38 of the base portion 30. In the illustrated embodiment, five branches 52*a-e* (shown in FIG. 2), 54*a-e* (not shown) from each manifold 42, 44, are directed downwardly, toward the strap S, as it enters and leaves the debris sweep and dry assist device 12 at the inlet 36 and outlet 38, respectively. It will be appreciated that the number of branches can vary depending upon the particular configuration of the device 12.

The branches 52, 54 open at outer walls 56, 58 of the base portion 30 into diverging outlets as indicated at 60. The diverging outlets 60 widen (or diverge) outflow of compressed air or gas so that the flow of air or gas from the outlets 60 covers the width $W_s$ of the strap S. The diverging outlets 60 can be formed as countersunk regions 62 in the branches 52, 54 as they open at the outer walls 56, 58. In the illustrated debris sweep and dry assist device 12, the branches 52, 54 are formed at an angle $\alpha$ of about 45 degrees to the plane $P_s$ of the strap S. The angle $\alpha$ can, of course, be more or less than 45 degrees and is intended to provide a jet-like effect to clear debris from the infed strap S at the inlet 36 and to facilitate drying (ink) at the outlet 38.

In a present debris sweep and dry assist device 12, compressed air is supplied to the manifolds 42, 44 by an air supply 62, such as an pump or the like. Conduits or tubing 64 can be provided to provide flow communication between the pump 62 (or supply) and the manifolds 42, 44. A preferred supply of compressed air is filtered and dried. It is anticipated that air or any compressed gas can be supplied from a number of systems that are present in most manufacturing plants, or can be provided by a local air pump system.

In use, strap S is conveyed from the strap dispenser 14 or any supply, through the debris sweep and dry assist device 12, and fed to a downstream process, such as the exemplary strapping machine 16. As strap S enters the base portion inlet 36, air is directed over the infed strap S which clears debris from the strap S prior to the strap S entering the base portion 30. In this manner, debris will be less likely to interfere with printing and less likely to clog the printer 34. In addition, the device 12 will limit or eliminate ink printing onto dust or debris particles that could otherwise clog the outlet 38 and/or smudge or impair the quality of the printing on the strap S. Indicia I is printed on the strap S by the printer 34 as is resides within (and as the strap S passes below) the carrier 32. As the strap S exits the base portion outlet 38, the air directed over the strap S (with printing thereon) will reduce the drying time needed for the printing ink.

A control system 66 can be used to control the flow or air from the air supply 62 (e.g., pump) to the manifolds 42, 44. The supplied air can be constant or it can be provided on an as needed (e.g., on-and-off) basis, for example, in coordination with a print command. It will be appreciated that the control system 66 can be common or integrated with the printing system 18 and/or the strapping machine 16 and/or overall strapping system 10.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A debris sweep and dry assist device for use with a strapping machine and a strap supply, the debris sweep and dry assist device being positioned between the strapping machine and the strap supply, the debris sweep and dry assist device comprising:

a body having a strap inlet and a strap outlet and defining a strap path therethrough, the body having a first outer wall at about the strap inlet and a second outer wall at about the strap outlet, the body having a first manifold and a plurality of first branches extending between the first manifold and the first outer wall to provide a plurality of flow paths from the first manifold to the environs outside of, and directed away from, the body through the first branches, wherein a compressed gas directed into the first manifold flows out of the first branches and is directed onto strap at a location outside of, and away from the body at about the strap inlet.

2. The debris sweep and dry assist device of claim 1 including a second manifold in the body, and a plurality of second branches extending between the second manifold and the second outer wall to provide a plurality of flow paths from the second manifold to the environs outside of the body through the second branches, and wherein a compressed gas directed into the second manifold flows out of the second branches and is directed onto strap at a location outside of the body at about the strap outlet.

3. The debris sweep and dry assist device of claim 2 wherein the second branches are in flow communication with diverging openings in the second outer wall.

4. The debris sweep and dry assist device of claim 3 wherein the diverging openings are formed as countersunk regions in the first and second outer walls.

5. The debris sweep and dry assist device of claim 2 wherein the first and second branches are formed an angle of about 45 degrees to the strap path.

6. The debris sweep and dry assist device of claim 1 wherein the first branches are in flow communication with diverging openings in the first outer wall.

7. The debris sweep and dry assist device of claim 1 wherein the first branches are formed at an angle of about 45 degrees to the strap path.

8. The debris sweep and dry assist device of claim 1 including a receiver mounted to the body, positioned between the inlet and the outlet, the receiver configured to receive a printing device.

9. The debris sweep and dry assist device of claim 1 including a compressed gas supply.

10. The debris sweep and dry assist device of claim 9 wherein the compressed gas supply is a compressed air supply.

11. A strapping system of the type for receiving strapping material from an associated strap supply and tensioning the strapping material around a load, comprising:

a strapping machine having a feed head, a sealing head and a strap chute; and a debris sweep and dry assist device, the debris sweep and dry assist device being positioned between the strapping machine and the associated strap supply, the debris sweep and dry assist device including a body having a strap inlet and a strap outlet and defining a strap path therethrough, the body having a first wall at about the strap inlet and a second wall at about the strap outlet, the body having a first manifold and a plurality of first branches extending between the first manifold and the first wall to provide a plurality of flow paths from the first manifold to the environs through the first branches, wherein a compressed gas directed into the first manifold flows out of the first branches and is directed onto strap at a location at about the strap inlet.

12. The strapping system of claim 11 including a receiver mounted to the body, positioned between the inlet and the outlet, the receiver configured to receive a printing device.

13. The strapping system of claim 11 including a second manifold and a plurality of second branches extending between the second manifold and the second wall to provide a plurality of flow paths from the second manifold to the environs through the second branches, and wherein a compressed gas directed into the second manifold flows out of the second branches and is directed onto strap at about the strap outlet in the strap path.

14. The strapping system of claim 13 wherein the first and second branches are in flow communication with diverging openings in the first and second walls, respectively.

15. The strapping system of claim 13 wherein the first and second branches are formed at an angle of about 45 degrees to the strap path.

16. The strapping system of claim 13 wherein the first and second branches are in flow communication with diverging openings in the first and second walls, respectively.

17. A debris sweep print head carrier for use with an associated strapping machine, comprising:

a debris sweep and dry assist device, the debris sweep and dry assist device being positioned between the associated strapping machine and a strap supply associated with the strapping machine, the debris sweep and dry assist device including a body having a strap inlet and a strap outlet and defining a strap path therethrough, the body having a first wall at about the strap inlet and a second wall at about the strap outlet, the body having a first manifold and a plurality of first branches extending between the first manifold and the first wall to provide a plurality of flow paths from the first manifold to the environs through the first branches, wherein a compressed gas directed into the first manifold flows out of the first branches and is directed onto strap at about the strap inlet; and a receiver mounted to the body, positioned between the strap inlet and the strap outlet, the receiver configured to receive a printing device.

18. The debris sweep print head carrier of claim 17 including a second manifold and a plurality of second branches extending between the second manifold and the second wall to provide a plurality of flow paths from the second manifold to the environs through the second branches, and wherein a compressed gas directed into the second manifold flows out of the second branches and is directed onto strap at about the strap outlet in the strap path.

19. The debris sweep print head carrier of claim 17 including a compressed gas supply.

20. The debris sweep print head carrier of claim 19 wherein the compressed gas supply is a compressed air supply.

* * * * *